US011284751B2

(12) United States Patent
Droessler

(10) Patent No.: US 11,284,751 B2
(45) Date of Patent: Mar. 29, 2022

(54) SHOWER BASE ASSEMBLY COMPATIBLE WITH RESIDENTIAL AND COMMERCIAL CONSTRUCTION

(71) Applicant: KurbX LLC, Black River Falls, WI (US)

(72) Inventor: Adam Michael Droessler, Dubuque, IA (US)

(73) Assignee: KURBX, LLC, Black River Falls, WI (US)

( * ) Notice: Subject to any disclaimer, the term of this patent is extended or adjusted under 35 U.S.C. 154(b) by 0 days.

(21) Appl. No.: 17/090,313

(22) Filed: Nov. 5, 2020

(65) Prior Publication Data

US 2021/0045588 A1 Feb. 18, 2021

Related U.S. Application Data

(63) Continuation-in-part of application No. 16/416,035, filed on May 17, 2019, now Pat. No. 10,856,702.

(60) Provisional application No. 62/676,918, filed on May 26, 2018.

(51) Int. Cl.
*A47K 3/40* (2006.01)
*E03C 1/22* (2006.01)

(52) U.S. Cl.
CPC . *A47K 3/40* (2013.01); *E03C 1/22* (2013.01)

(58) Field of Classification Search
CPC ..... A47K 3/283; A47K 3/284; A47K 3/008; A47K 3/004; A47K 3/40; A47K 3/405; E03F 5/0407; E03F 5/0408; E03F 5/0409; E03C 1/20; E03C 1/22; E04F 15/02188; F16L 21/02; F16L 21/022; F16L 19/07; F16L 19/0218
See application file for complete search history.

(56) References Cited

U.S. PATENT DOCUMENTS

| | | | |
|---|---|---|---|
| 1,818,653 | A | 8/1931 | Steen |
| 2,055,173 | A | 9/1936 | Deubelbeiss |
| 2,239,969 | A | 4/1941 | Morthland |
| 2,394,964 | A | 2/1946 | Dick |

(Continued)

FOREIGN PATENT DOCUMENTS

WO WO 2019/231769 A1 12/2019

OTHER PUBLICATIONS

International Search Report and Written Opinion, PCT Appln. No. PCT/US2019/033386, dated Jul. 25, 2019, 7 pages.

(Continued)

*Primary Examiner* — Patrick M. Buechner
(74) *Attorney, Agent, or Firm* — Craig A. Fieschko, Esq.; DeWitt LLP

(57) ABSTRACT

A shower base assembly includes a shower base, a drain grate frame, a double-threaded flange nipple, and a rubber gasket. The shower base includes a upper side pre-sloped to allow for water drainage to drain hole extending to a lower side of the shower base. The drain grate frame is insertable through the drain hole from the shower base upper side to be received within the double-threaded flange nipple. An industry standard plumbing drain body may engage the double-threaded flange nipple from the shower base lower side. The rubber gasket is compressed against the shower base about the drain hole between the double-threaded flange nipple and the drain body.

20 Claims, 7 Drawing Sheets

(56) References Cited

U.S. PATENT DOCUMENTS

| | | | | |
|---|---|---|---|---|
| 2,437,068 | A | 3/1948 | Birdwell | |
| 2,484,240 | A | 10/1949 | Morthland | |
| 2,626,674 | A | 1/1953 | Boosey | |
| 2,705,542 | A | 4/1955 | Morris | |
| 2,757,385 | A | 8/1956 | Whittick | |
| 2,780,303 | A | 2/1957 | Morris | |
| 3,724,883 | A | 4/1973 | Dennis, Jr. | |
| 3,742,525 | A * | 7/1973 | Oropallo | E03C 1/22 4/288 |
| 3,742,883 | A | 7/1973 | Oropallo | |
| 3,744,065 | A | 7/1973 | Yavitch | |
| 3,937,497 | A | 2/1976 | Studer | |
| 4,067,072 | A | 1/1978 | Izzi | |
| 4,092,745 | A * | 6/1978 | Oropallo | E03F 5/0408 4/288 |
| 4,539,721 | A * | 9/1985 | Moore | A47K 3/284 4/613 |
| 4,541,132 | A | 9/1985 | Long | |
| 4,557,004 | A | 12/1985 | Paina | |
| 4,978,250 | A | 12/1990 | Dallmer | |
| 5,022,430 | A | 6/1991 | Degooyer | |
| 5,140,789 | A | 8/1992 | De Gooyer | |
| 5,216,767 | A | 6/1993 | Elmore | |
| 5,745,931 | A | 5/1998 | Ball | |
| 5,913,777 | A | 6/1999 | Gerber | |
| 6,175,971 | B1 * | 1/2001 | O'Neill | E03C 1/22 4/288 |
| 8,043,497 | B2 | 10/2011 | Silverstein | |
| D706,912 | S | 6/2014 | Toms | |
| D706,913 | S | 6/2014 | Toms | |
| 8,918,926 | B1 | 12/2014 | Herring | |
| 9,848,742 | B2 | 12/2017 | Phillips | |
| 10,053,851 | B2 | 8/2018 | Toms et al. | |
| 10,856,702 | B2 * | 12/2020 | Droessler | A47K 3/405 |
| 2006/0108558 | A1 * | 5/2006 | Wooldridge | E03C 1/22 251/344 |
| 2007/0017578 | A1 | 1/2007 | Dallmer | |
| 2008/0022455 | A1 | 1/2008 | McAlpine | |
| 2008/0163420 | A1 | 7/2008 | Dieter | |
| 2008/0222794 | A1 | 9/2008 | Cook | |
| 2010/0064430 | A1 | 3/2010 | Goodson | |
| 2010/0071125 | A1 | 3/2010 | Miller | |
| 2010/0170035 | A1 | 7/2010 | Kik, Sr. | |
| 2010/0320130 | A1 | 12/2010 | Meyers | |
| 2011/0088160 | A1 | 4/2011 | Stimpson | |
| 2011/0197351 | A1 | 8/2011 | Cook | |
| 2012/0272449 | A1 | 11/2012 | Wedi | |
| 2014/0000022 | A1 * | 1/2014 | McLeod | E03C 1/22 4/652 |
| 2014/0131996 | A1 | 5/2014 | Murphy | |
| 2014/0157514 | A1 | 6/2014 | Cook | |
| 2017/0204592 | A1 * | 7/2017 | Chen | E03C 1/22 |
| 2019/0242107 | A1 | 8/2019 | McLeod | |
| 2021/0071404 | A1 * | 3/2021 | Boeltl | E03F 5/0408 |
| 2021/0115655 | A1 * | 4/2021 | Brill | E03F 5/0408 |

OTHER PUBLICATIONS

Sioux Chief 825 Series, solvent weld shower module drain, Part No. 825-2A, Oct. 9, 2008, http://www.siouxchief.com/products/drainage/residential/shower-drains/shower-module/825-series/snap-in-stainless-steel-strainer.

* cited by examiner

SHOWER BASE ASSEMBLY COMPATIBLE WITH RESIDENTIAL AND COMMERCIAL CONSTRUCTION

CROSS-REFERENCE TO RELATED APPLICATIONS

This application is a continuation-in-part of U.S. patent application Ser. No. 16/416,035 (now U.S. Pat. No. 10,856,702), which in turn claims priority to U.S. Provisional Patent Application 62/678,918, both of which are incorporated by reference herein.

FIELD OF INVENTION

The invention pertains to shower installations. In particular, but not by way of limitation, the invention provides systems and methods for a tile-over shower base assembly with a centered drain compatible with a double-threaded flange nipple.

SUMMARY

The invention involves a shower base assembly compatible with residential and commercial construction. Preferred versions of the assembly include a double-threaded flange nipple having a top nipple flange and a nipple conduit descending therefrom, with the nipple conduit being configured to fit within a shower base drain hole extending between upper and lower sides of a shower base. The nipple conduit has an interior circumference bearing gate threading thereon, with the gate threading being configured to engage a drain grate frame fit within the drain hole of the shower base from the upper shower base side. The nipple conduit also has an exterior circumference bearing body threading thereon, with the body threading being configured to engage an industry standard plumbing drain body situated below the lower shower base side. The top nipple flange extends radially outwardly from the nipple conduit to rest radially outwardly from the upper and body threading. When the drain body is threaded onto the lower exterior threading of the nipple conduit (with the drain grate frame being threaded into the upper interior threading of the nipple conduit), the top nipple flange bearing against the upper side of the shower base is drawn toward the drain body bearing against the lower side of the shower base. Thus, a gasket resting against the shower base to extend about the drain hole of the shower base is compressed between the double-threaded flange nipple and the plumbing drain body, and against the shower base, by engagement of the drain body with body threading on the double-threaded flange nipple. This decreases the need to waterproof the upper side of the shower base during installation (i.e., during connection to the drain at the drain body).

In preferred versions of the double-threaded flange nipple, the gate threading is defined on spaced sectors of the interior circumference of the double-threaded flange nipple.

In preferred versions of the double-threaded flange nipple, the drain grate frame has an upper drain grate frame tray which is configured to complementarily receive a drain grate, and also has a threaded drain grate frame conduit descending from the frame tray, wherein the threaded drain grate frame conduit has exterior threading configured to engage the gate threading of the double-threaded flange nipple.

The shower base is preferably sized such that it can span across floor joists of an underlying substrate (e.g., a floor), and is sloped such that it provides water drainage toward the drain hole. The drain hole preferably has a diameter of less than 3.5 inches, and more preferably less than 3.25 inches, reducing the possibility that the drain hole will rest over an obstruction (e.g., a floor joist) in an underlying substrate during installation. In similar respects, if the shower base includes a protruding reinforcement ring about the drain hole, it preferably has a diameter of less than 4.5 inches, and more preferably less than 4.25 inches, to reduce the likelihood of interference with an obstruction in the substrate during installation. The shower base preferably has a thickness of less than 1 inch, and may have a "waffled" surface (with grooves spaced across its length and width), so that it can more easily bend to fit the contours on an uneven substrate beneath. The upper surface of the shower base preferably has a textured surface to allow better bonding of tile-setting mortar thereon, with the textured surface preferably having surface relief varying about 0.004 inches or less.

DETAILED DESCRIPTION

The following description and accompanying drawings illustrate specific examples of the invention, but as these are merely examples, it should be understood that the invention may take forms other than those described and illustrated. The claims set forth at the end of this document define the various versions of the invention in which exclusive rights are secured.

Many existing shower base installations have a large drain hole, requiring that the drain hole be located away from the center of the base, and/or that the perimeter of the drain hole be reinforced, to deter breakage of the base. The reinforcement is typically provided by a downwardly-protruding reinforcement ring about the drain hole on the bottom side of the shower base. The off-center drain hole is not optimal for drainage. Moreover, the large drain hole and its reinforcement ring make it difficult to avoid installation obstructions (e.g., wooden joists, post tension cables, and the like), and the protruding ring causes installation compatibility problems where the reinforcement ring interferes with a floor atop which the base is to be installed.

The invention provides a shower base having a drain hole with having small diameter, and which may be centrally located, and have a reinforcement ring having low or no depth on a bottom side of the base, thereby reducing or avoiding these problems. The shower base may be tiled over following installation.

Figure 1:
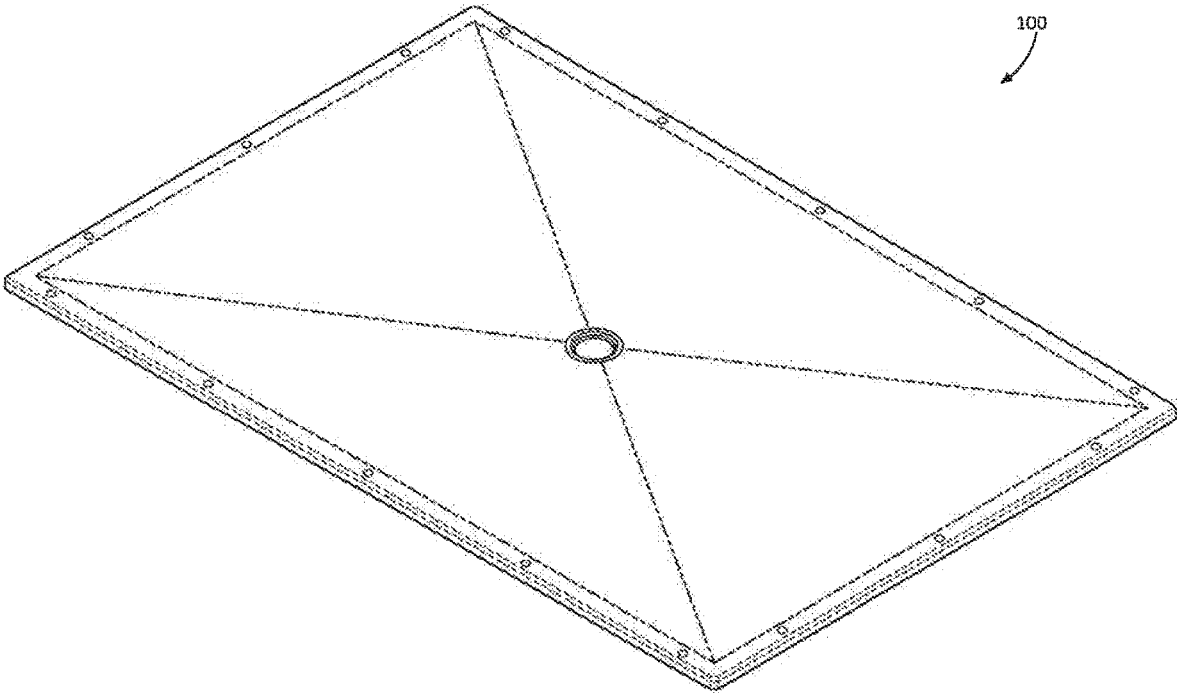
FIG. 1 illustrates a top perspective view of an exemplary shower base assembly in accordance with the invention, having a center drain.

FIG. 1 illustrates a top perspective view of an exemplary shower base compatible with residential and commercial construction. The shower base 100 (also known as a shower pan, shower tray, shower foundation, or shower receptor) is a pitched (depressed) base typically formed of reinforced plastics and compound resins including, but not limited to, glass reinforced plastic, fiberglass reinforced plastic, and the like. For example, the shower base 100 may be formed of glass-mat thermoplastic (GMT). Exemplary dimensions for the shower base 100 are 47.25 inches by 71 inches, although the shower base 100 may be cut to different sizes for customization and compatibility. The shower base 100 may span across floor joists, and may be fastened to a substrate beneath using fasteners to create a pre-pitched shower area to be waterproofed at the edges of the pan and covered with a finished floor covering (e.g., tiles).

Figure 2A:
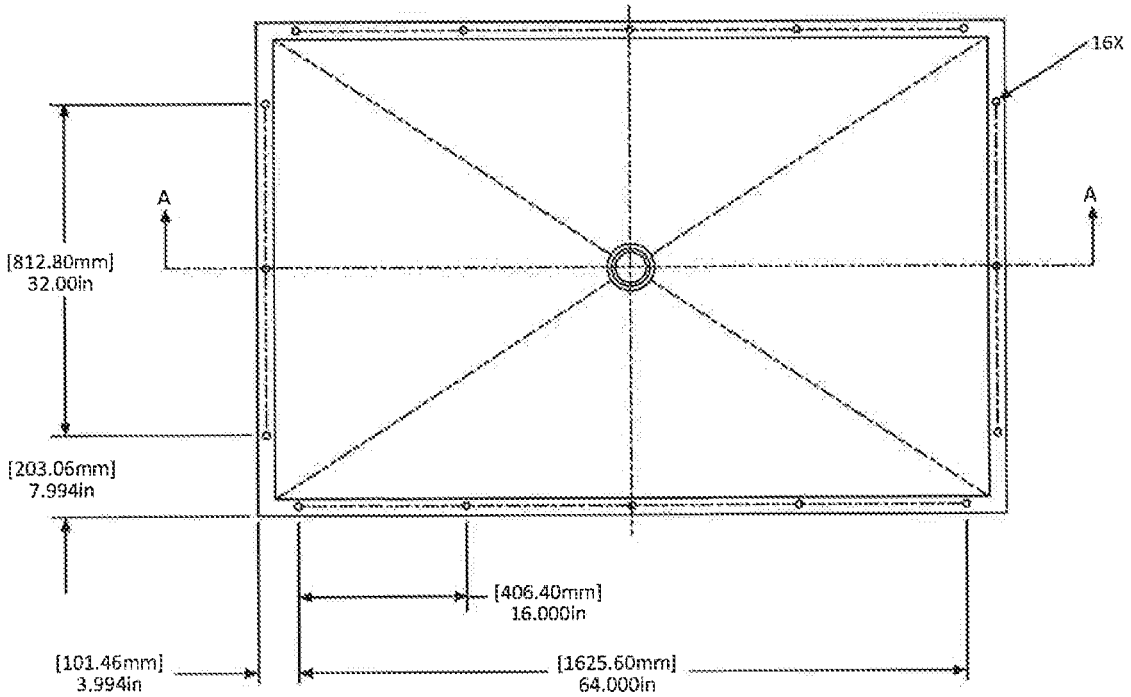
FIG. 2A illustrates a top view of the exemplary shower base assembly of FIG. 1.
Figure 4:
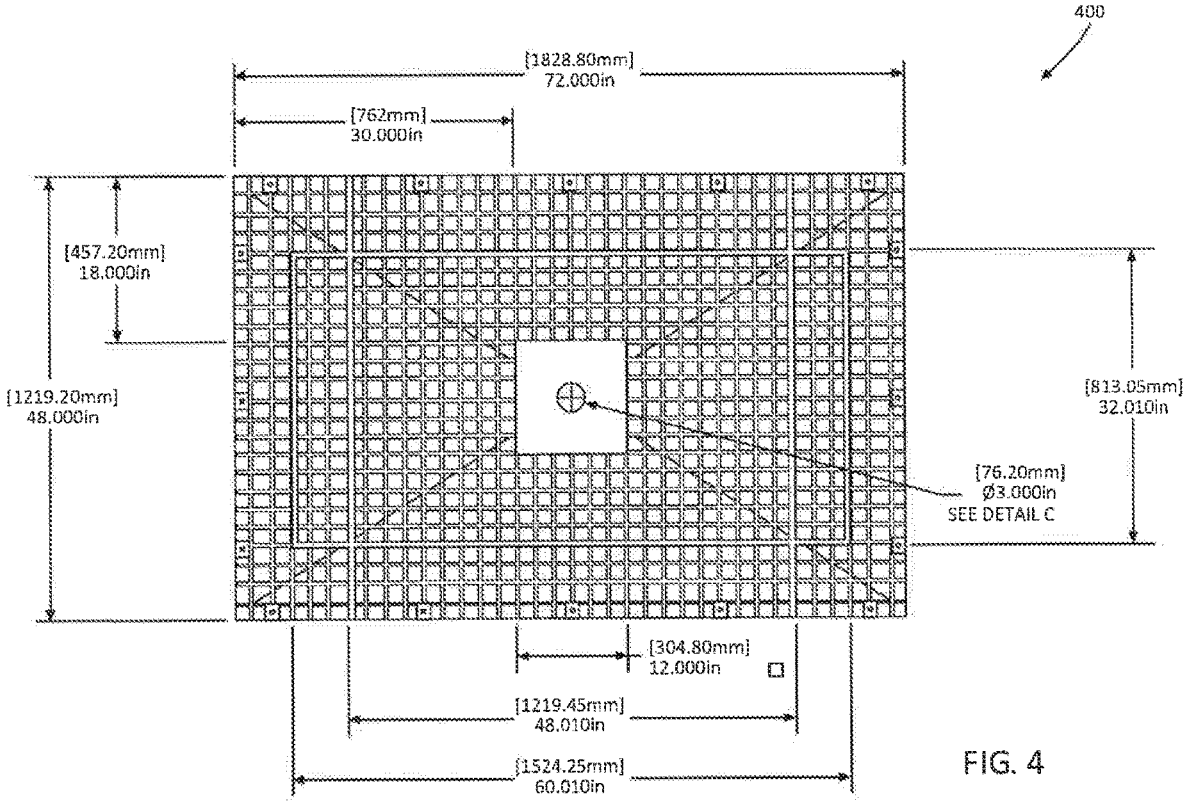
FIG. 4 illustrates a bottom view of the exemplary shower base assembly of FIGS. 1-3.

The shower base 100 has a pre-sloped upper side to allow for consistent water drainage through an upper opening of a centrally-located drain hole extending through to the lower side of the shower pan (shown in FIG. 4). FIG. 2A shows the centered drain hole location and exemplary dimensions of the shower base. In some instances—for example, for installation of a tub conversion to a shower—the drain hole is not centered for convenience of the installer with regards to existing plumbing in the floor. The upper side of the tile-over shower base may have a textured surface, preferably having a depth of 0.004 inches or less, which bonds well with tile-setting mortar.

Figure 2B:
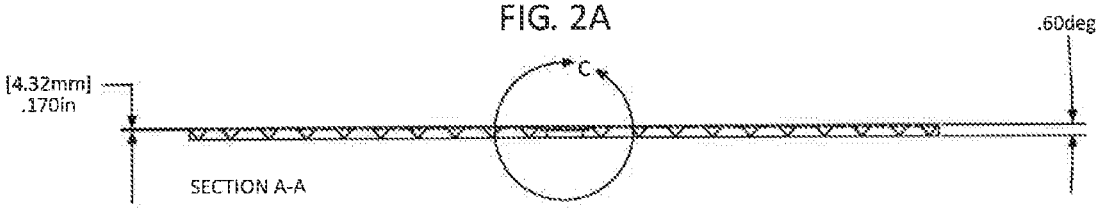
FIG. 2B illustrates a side sectional view of the exemplary shower base assembly of FIGS. 1 and 2A, as seen from the section line A-A in FIG. 2A.

FIG. 2B illustrates a side view of the shower base. The drain hole is preferably reduced to the smallest diameter possible to still meet plumbing drainage codes. The diameter of the drain hole is preferably less preferably less than 3.5 inches, reducing the possibility that the drain hole will rest above an obstruction in a substrate during installation. The diameter of any reinforcing ring protruding from the bottom side of the shower base is preferably less than 4.5 inches, similarly reducing the possibility that the drain hole will rest above an obstruction in a substrate during installation.

Figure 3:
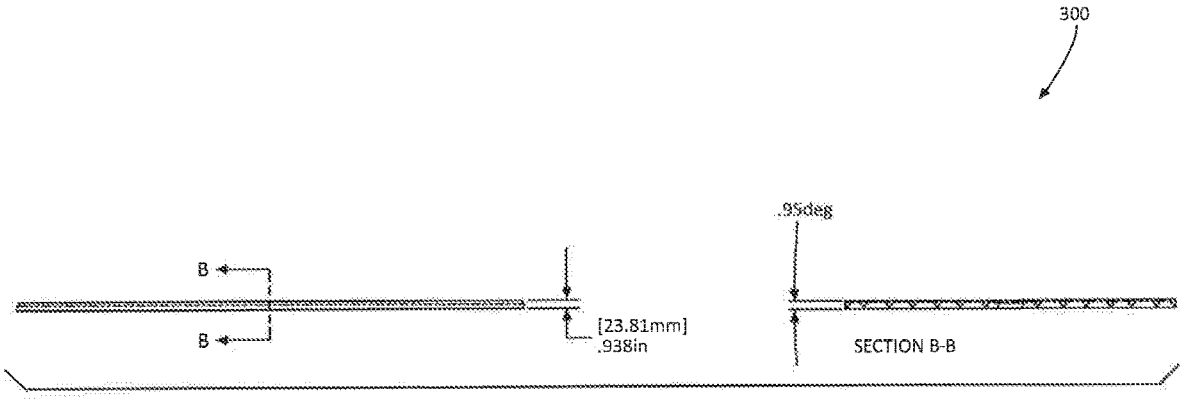
FIG. 3 illustrates another side view of the exemplary shower base assembly of FIGS. 1-2B, showing the region C in FIG. 2B.

FIG. 3 illustrates a cross-sectional side view 300 of the shower base, depicting the region C of FIG. 2B, and exemplary dimensions.

FIG. 4 illustrates a bottom view 400 of the shower base, with exemplary dimensions, showing the lower side of the base and the lower opening of the drain hole. The shower base is preferably less than 1 inch thick, and the lower side of the shower base has "waffled" construction. These features reduce the material necessary to make the shower base and reduce its weight, and provide easy deflection/bending of the shower base when an underlying substrate is uneven.

Figure 5A:
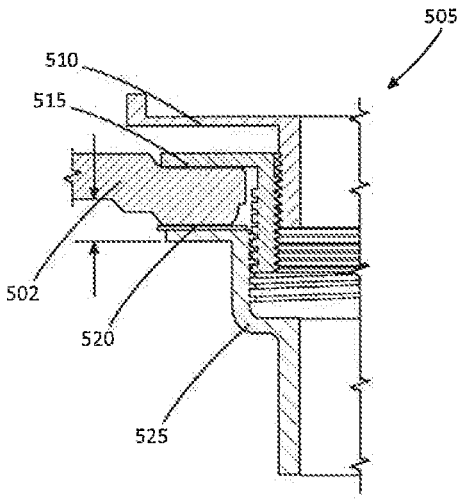
FIG. 5A illustrates a cross-sectional view of a portion of the exemplary shower base assembly of FIGS. 1-4.
Figure 5B:
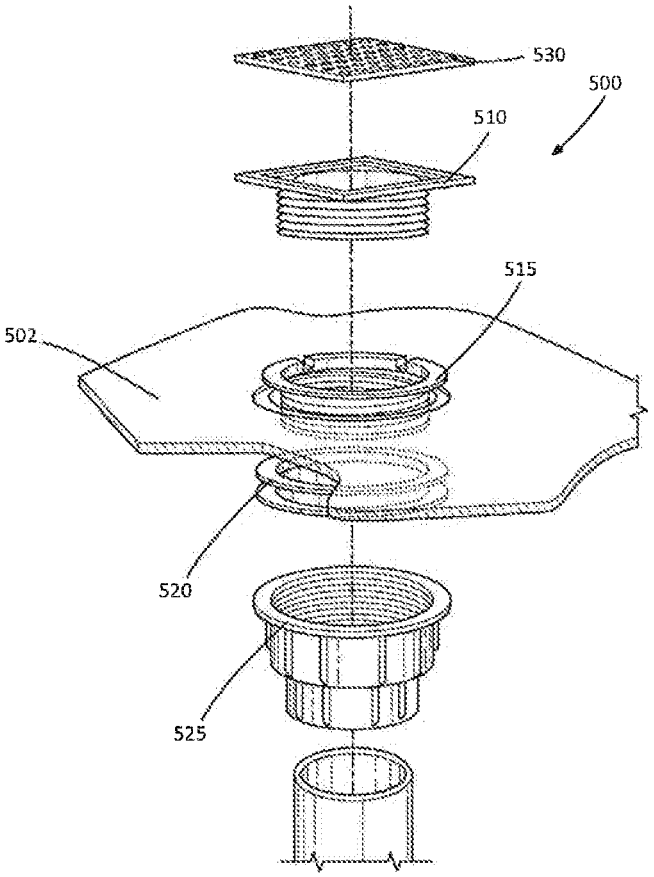
FIG. 5B illustrates a side perspective view of drain installation of the exemplary shower base assembly of FIGS. 1-5A.

FIG. 5B illustrates an exploded/disassembled side perspective view 500 of a shower base assembly which includes the shower base (depicted at 502), and FIG. 5A illustrates a cross-sectional view 505 of portions of the assembled shower base assembly. Looking to view 500, the assembly includes a drain grate 530; a drain grate frame 510 compatible with the drain hole in the shower base 502; a double-threaded flange nipple 515 having inner threading compatible with the drain grate frame 510 and outer threading compatible with an industry standard plumbing drain body 525; and a compressible (e.g., rubber or Teflon®) gasket 520 that gets compressed between the reinforcement ring bounding the drain hole of the shower base 502 and the plumbing drain body 525 by the double-threaded flange nipple 515, thereby forming a water-tight seal between the double-threaded flange nipple 515 and the drain body 525. This arrangement decreases installation time of the shower base assembly because the upper side of the tile-over shower base 502 does not need to be waterproofed in order to seal the juncture between the shower base 502 and the double-threaded flange nipple 515.

The grate 530 is preferably removably fit within the drain grate frame 510. The grate frame 530 preferably has a drain throat wider than an industry standard drain throat, allowing for increased water flow.

Figure 6A:
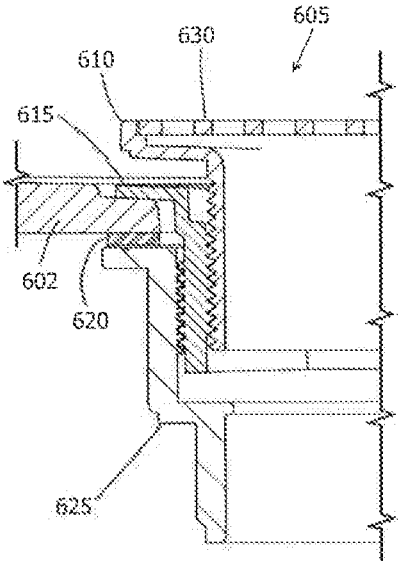
FIG. 6A illustrates a cross-sectional view of a portion of a second exemplary shower base assembly.
Figure 6B:
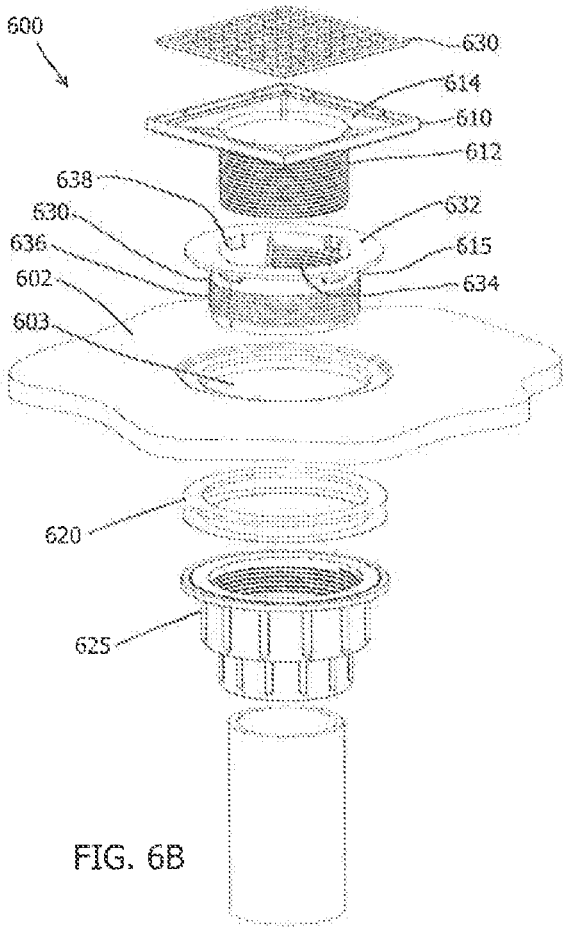
FIG. 6B illustrates a side perspective view of drain installation of the second exemplary shower base assembly of FIG. 6A.
Figure 7:
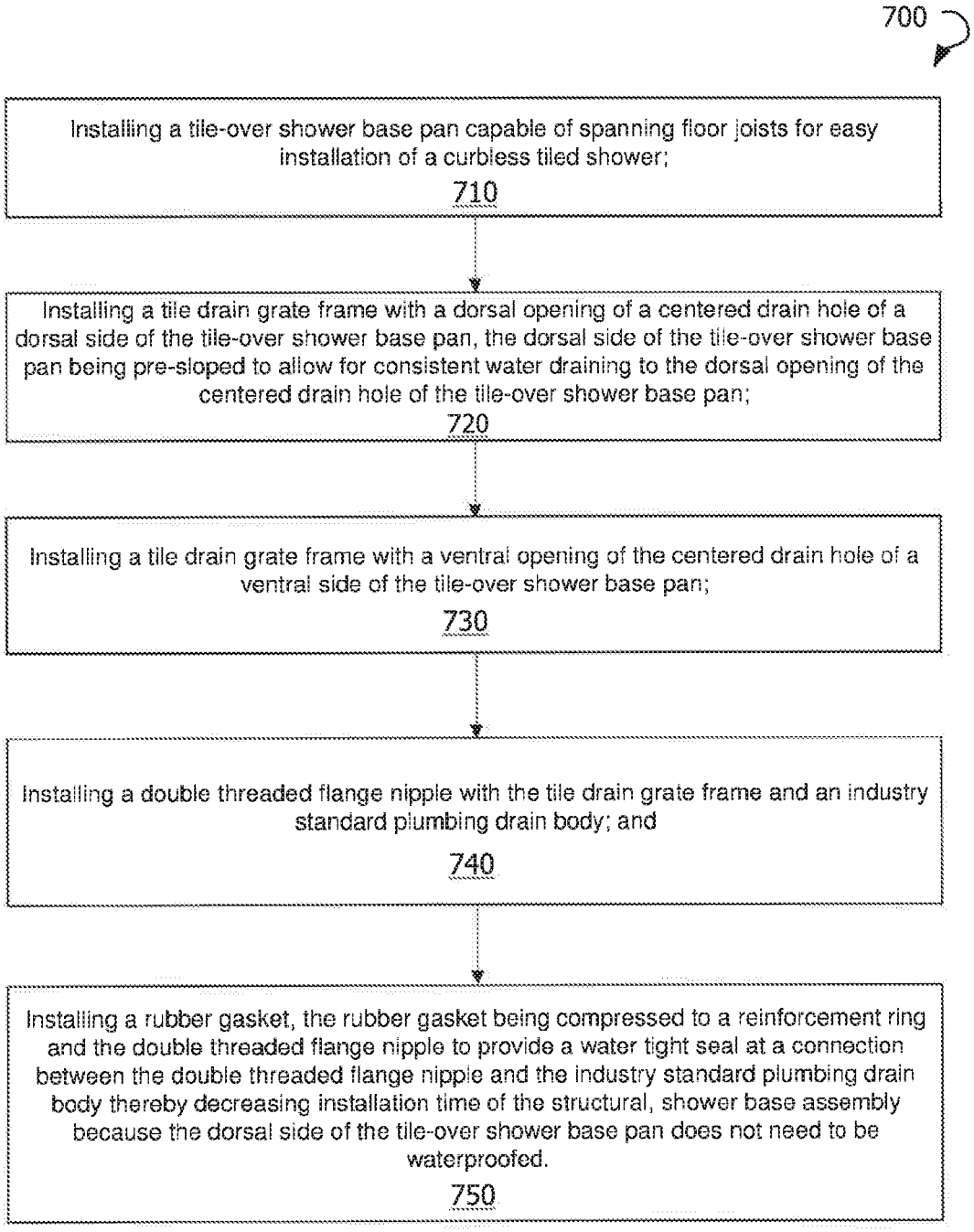
FIG. 7 is a process flow diagram showing a method for installation of a shower base assembly.

FIG. 6B illustrates the installation of an alternative version of the double-threaded flange nipple 615 within a shower base assembly 600, with FIG. 6A showing the completed assembly at 605. The double-threaded flange nipple 615 is similar to the double-threaded flange nipple 515 of FIGS. 5A-5B, having a nipple conduit 630 sized to fit within the drain hole 603 of the shower base 602, and a radially-outwardly-extending top flange 632. The interior circumference of the nipple conduit 630 bears gate threading 634 for engaging the threaded drain grate frame conduit 612 extending below the upper drain grate frame tray 614 of the drain grate frame 610, and the exterior circumference of the nipple conduit 630 bears body threading 636 for engaging the drain body 625. However, in this version of the double-threaded flange nipple 615, the gate threading 634 is does not continuously extend about the circumference of the nipple conduit 630, and is instead defined on spaced sectors of the interior circumference of the double-threaded flange nipple 615, e.g., the threads 634 extend across two sectors, each extending about approximately one-quarter of the interior circumference of the double-threaded flange nipple 615, with these sectors being spaced by unthreaded sectors 638 on the interior circumference of the double-threaded flange nipple 615. The unthreaded sectors—which may also include apertures extending through the wall of the nipple conduit. 630 (as depicted)—thereby help to define "weep holes" which assist with drainage, FIG. 7 is a process flow diagram showing a method 700 for installation of the shower base assembly. The method 700 may commence at step 710 with installing a tile-over shower base capable of spanning floor joists for easy installation of a curbless tiled shower.

At step 720, a drain grate frame may be inserted from the upper side of the shower base into the upper opening of the drain hole.

At step 730, the drain grate frame may be received through the lower opening of the drain hole.

At step 740, a double-threaded flange nipple can be connected between the drain grate frame and an industry standard plumbing drain body.

At step 750, a compressible gasket may be compressed against the reinforcement ring of the shower base by screwing the double-threaded flange nipple to the industry standard plumbing drain body to provide a water tight seal at a connection between the double-threaded flange nipple and the industry standard plumbing drain body.

While installation steps are depicted in a given order, they may be performed in a different order, and some steps may be deleted, moved, added, subdivided, combined, and/or modified. Steps may be performed simultaneously or at different times.

While this technology is susceptible of embodiments in many different forms, there is shown in the drawings and has been described in detail several specific embodiments with the understanding that the present disclosure is to be considered as an exemplification of the principles of the technology and is not intended to limit the technology to the embodiments illustrated.

Although the terms first, second, etc. may be used herein to describe various elements, components, regions, layers and/or sections, these elements, components, regions, layers and/or sections should not necessarily be limited by such terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be necessarily limiting of the disclosure. As used herein, the singular forms "a," "an" and "the" are intended to include the plural forms as well, unless the context clearly indicates otherwise. The terms "comprises," "includes" and/or "comprising," "including" when used in this specification, specify the presence of stated features, integers, steps, operations, elements, and/or components, but do not preclude the presence or addition of one or more other features, integers, steps, operations, elements, components, and/or groups thereof.

Example embodiments of the present disclosure are described herein with reference to illustrations of idealized embodiments (and intermediate structures) of the present disclosure. As such, variations from the shapes of the illustrations as a result, for example, of manufacturing techniques and/or tolerances, are to be expected. Thus, the example embodiments of the present disclosure should not be construed as necessarily limited to the particular shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing and/or other any other types of manufacturing. For example, some manufacturing processes include three dimensional (3D) printing, laser cutting, computer numerical control (CNC) routing, milling, pressing, stamping, vacuum forming, hydroforming, injection molding, lithography and/or others.

Any and/or all elements, as disclosed herein, can include, whether partially and/or fully, a solid, including a metal, a mineral, a ceramic, an amorphous solid, such as glass, a glass ceramic, an organic solid, such as wood and/or a polymer, such as rubber, a composite material, a semiconductor, a nano-material, a biomaterial and/or any combinations thereof. Any and/or all elements, as disclosed herein, can include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, non-transparency, luminescence, anti-reflection and/or holographic, a photo-sensitive coating, an electronic and/or thermal property coating, such as for passivity, insulation, resistance or conduction, a magnetic coating, a water-resistant and/or waterproof coating, a scent coating and/or any combinations thereof.

Unless otherwise defined, all terms (including technical and scientific terms) used herein have the same meaning as commonly understood by one of ordinary skill in the art to which this disclosure belongs. The terms, such as those defined in commonly used dictionaries, should be interpreted as having a meaning that is consistent with their meaning in the context of the relevant art and should not be interpreted in an idealized and/or overly formal sense unless expressly so defined herein.

Furthermore, relative terms such as "below," "lower," "above," and "upper" may be used herein to describe one element's relationship to another element as illustrated in the accompanying drawings. Such relative terms are intended to encompass different orientations of illustrated technologies in addition to the orientation depicted in the accompanying drawings. For example, if a device in the accompanying drawings is turned over, then the elements described as being on the "lower" side of other elements would then be oriented on "upper" sides of the other elements. Similarly, if the device in one of the figures is turned over, elements described as "below" or "beneath" other elements would then be oriented "above" the other elements. Therefore, the example terms "below" and "lower" can, therefore, encompass both an orientation of above and below.

The description of the present disclosure has been presented for purposes of illustration and description, but is not intended to be exhaustive or limited to the present disclosure in the form disclosed. Many modifications and variations will be apparent to those of ordinary skill in the art without departing from the scope and spirit of the present disclosure. Exemplary embodiments were chosen and described in order to best explain the principles of the present disclosure and its practical application, and to enable others of ordinary skill in the art to understand the present disclosure for various embodiments with various modifications as are suited to the particular use contemplated.

While various embodiments have been described above, it should be understood that they have been presented by way of example only, and not limitation. The descriptions are not intended to limit the scope of the technology to the particular forms set forth herein. Thus, the breadth and scope of a preferred embodiment should not be limited by any of the above-described exemplary embodiments. It should be understood that the above description is illustrative and not restrictive. To the contrary, the present descriptions are intended to cover such alternatives, modifications, and equivalents as may be included within the spirit and scope of the technology as defined by the appended claims and otherwise appreciated by one of ordinary skill in the art. The scope of the technology should, therefore, be determined not with reference to the above description, but instead should be determined with reference to the appended claims along with their full scope of equivalents.

What is claimed is:

1. A shower base assembly compatible with residential and commercial construction, the assembly including a double-threaded flange nipple having a top nipple flange and a nipple conduit descending therefrom, wherein:

a. the nipple conduit is configured to fit within a drain hole extending between upper and lower sides of a shower base, b. the nipple conduit has an interior circumference bearing gate threading thereon, the gate threading being configured to engage a drain grate frame fit within the drain hole of the shower base from the upper shower base side, c. the nipple conduit has an exterior circumference bearing body threading thereon, the body threading being configured to engage an industry standard plumbing drain body situated below the lower shower base side, d. the top nipple flange extends radially outwardly from the nipple conduit to rest radially outwardly from the body threading, whereby a gasket resting against the shower base to extend about the drain hole of the shower base is compressed between the double-threaded flange nipple and the plumbing drain body, and against the shower base, by engagement of the plumbing drain body with the body threading on the double-threaded flange nipple.

2. The shower base assembly of claim 1 wherein the gate threading is defined on spaced sectors of the interior circumference of the double-threaded flange nipple.

3. The shower base assembly of claim 1 wherein the nipple conduit has a diameter of less than 3.25 inches.

4. A shower base assembly compatible with residential and commercial construction, the assembly including:

a. a shower base capable of spanning floor joists for installation of a shower, the shower base having an upper shower base side and an opposing lower shower base side, with a drain hole extending therebetween;

b. a drain grate frame, the drain grate frame being fittable within the drain hole of the shower base from the upper shower base side;

c. a double-threaded flange nipple, the double-threaded flange nipple having:

(1) gate threading configured to engage the drain grate frame, and (2) body threading configured to engage an industry standard plumbing drain body situated below the lower shower base side;

d. a gasket configured to:

(1) rest against the shower base to extend about the drain hole of the shower base, and (2) be compressed between the double-threaded flange nipple and the plumbing drain body against the shower base.

5. The shower base assembly of claim 4 wherein the double-threaded flange nipple includes a top nipple flange situated radially outwardly from the body threading.

6. The shower base assembly of claim 4 wherein the drain hole has a diameter of less than 3.25 inches.

7. The shower base assembly of claim 4 wherein the shower base has a thickness of less than 1 inch.

8. The shower base assembly of claim 4 wherein the double-threaded flange nipple includes:

a. an interior circumference having the gate threading thereon, and b. an exterior circumference having the body threading thereon.

9. The shower base assembly of claim 8 wherein the gate threading is defined on spaced sectors of the interior circumference of the double-threaded flange nipple.

10. The shower base assembly of claim 4 wherein the double-threaded flange nipple includes:

a. a nipple conduit bearing the body threading, the nipple conduit being configured to fit within the drain hole of the shower base, and b. a top nipple flange from which the nipple conduit descends, the top nipple flange extending radially outwardly from the nipple conduit.

11. The shower base assembly of claim 10 wherein the nipple conduit includes:

a. an interior circumference having the gate threading thereon, and b. an exterior circumference having the body threading thereon.

12. The shower base assembly of claim 11 wherein the gate threading is defined on sectors spaced about the interior circumference of the double-threaded flange nipple.

13. The shower base assembly of claim 4 wherein the drain grate frame includes an upper drain grate frame tray having a threaded drain grate frame conduit descending therefrom.

14. The shower base assembly of claim 13 wherein the threaded drain grate frame conduit has exterior threading configured to engage the gate threading of the double-threaded flange nipple.

15. The shower base assembly of claim 13 further including a grate fit within the upper tray.

16. A method for shower base assembly installation compatible with residential and commercial construction, the method including the steps of:

a. situating a shower base atop floor joists for installation of a shower, the shower base having an upper shower base side and an opposing lower shower base side, with a drain hole extending therebetween;

b. fitting a drain grate frame within the drain hole of the shower base from the upper shower base side, c. engaging the drain grate frame with gate threading on a double-threaded flange nipple, d. engaging an industry standard plumbing drain body situated below the lower shower base side with body threading on the double-threaded flange nipple, e. resting a gasket against the shower base to extend about the drain hole of the shower base, and f. compressing the gasket:

(1) between the double-threaded flange nipple and the plumbing drain body, and (2) against the shower base.

17. The method of claim 16 wherein the double-threaded flange nipple has:

a. a nipple conduit bearing the body threading, and b. a top nipple flange from which the nipple conduit descends, the top nipple flange extending radially outwardly from the nipple conduit.

18. The method of claim 16 wherein the double-threaded flange nipple includes a top nipple flange situated radially outwardly from the body threading.

19. The method of claim 16 wherein the double-threaded flange nipple has:

a. an interior circumference having the gate threading thereon, and b. an exterior circumference having the body threading thereon.

20. The method of claim 19 wherein the gate threading is defined on spaced sectors of the interior circumference of the double-threaded flange nipple.

* * * * *